US005943934A

United States Patent [19]

Codatto

[11] Patent Number: 5,943,934

[45] Date of Patent: Aug. 31, 1999

[54] CUTTING DEVICE WITH MOVABLE PUNCH

[75] Inventor: Antonio Codatto, Lonigo, Italy

[73] Assignee: Sapim Amada S.p.A., Lonigo, Italy

[21] Appl. No.: 08/957,822

[22] Filed: Oct. 27, 1997

Related U.S. Application Data

[63] Continuation of application No. 08/591,698, Jan. 25, 1996, abandoned.

[30] Foreign Application Priority Data

Jan. 25, 1995 [IT] Italy ..... VI95A0012

[51] Int. Cl.[6] ..... B26D 7/00

[52] U.S. Cl. ..... 83/684; 83/686; 83/698.91; 83/140

[58] Field of Search ..... 83/140, 698.91, 83/684, 685, 686

[56] References Cited

U.S. PATENT DOCUMENTS

| | | | |
|---|---|---|---|
| 2,108,619 | 2/1938 | Smith | 83/140 |
| 2,584,415 | 2/1952 | Barnett | 83/140 |
| 2,847,069 | 8/1958 | Kopczynski | 83/686 |
| 2,867,276 | 1/1959 | Taylor | 83/140 |
| 3,086,419 | 4/1963 | Fox | 83/698.91 |
| 3,329,051 | 7/1967 | Derwin | 83/684 |
| 3,935,772 | 2/1976 | Demus et al. | 83/140 |
| 4,092,888 | 6/1978 | Wilson | 83/140 |
| 4,248,111 | 2/1981 | Wilson et al. | 83/698.91 |
| 5,012,712 | 5/1991 | Nordquist | 83/698.91 |

*Primary Examiner*—M. Rachuba
*Attorney, Agent, or Firm*—Bucknam and Archer

[57] ABSTRACT

The cutting device with movable punch is of the type which has a body placed within a seat (2) which is formed in the structure (3) of the machine, and also a fixed die (4), a movable upright (5) and an elastic element (6). In particular the body is constituted by a punch placed in the central position within the seat (2), a shaped element (8) coaxial with the punch and a blank-holder (9) which is integral with the terminal lower part of the shaped element (8).

4 Claims, 4 Drawing Sheets

6
8
7
19
9
IV
IV
III
III
7
18
10
14
12
11
VI
VII
7
8
17
18
VIII
VIII
18
18
VII
VII
13
14
22
12
16
13
14
20
9
9

CUTTING DEVICE WITH MOVABLE PUNCH

This is a Continuation of application Ser. No. 08/591,698, filed Jan. 25, 1996, now abandoned.

FIELD OF THE INVENTION

The present invention relates to a cutting device for performing the operation of cutting metal sheets.

BACKGROUND OF THE INVENTION

In the industrial field the operation of cutting is a mechanical operation by means of which one piece of metal is detached from another by working with special tools which are capable of cutting.

This operation is performed by applying a suitable pressure with the tool (blade or punch) in one area of the material so as to make it slide with respect to the others.

The tool used is a blade if the cuts to be made are open but it is a punch if-the cuts are of closed profile.

The cutting is a very rapid operation. It produces well-defined shapes in an instant and is particularly suitable for the working of metal sheets.

Opposite to the tool, which has a rectilinear movement, is the die, in fixed position, which functions as support for the metal sheet and enables it to be cut.

Initially the tool displays its action with a compression of the material, causing a plastic deformation to take place which creates a hollow body; in the subsequent phase, the compression force, which increases gradually, reaches and exceeds the value of the shear strength thus producing the detachment of a portion of metal sheet.

During the cutting operation, the fibers of the metal sheet, adjacent to the cutting corner of the punch, are bent following the movement of the tool for a short path prior to the stage when they are finally cut, so that they are compressed and deformed along the entire cut contour.

In particular, because of the elasticity of the material, internal reactions occur, in correspondence with the cut fibers, and these reactions cause the appearance of appreciable friction between the slide walls and this friction prevents the exit of the cut disc from the die and the removal of the punch from the hole of the metal sheet.

For the purpose of avoiding these drawbacks, a blank-holder is used which, by acting by compression in the vicinity of the edge to be cut, from the time prior to the action of the punch and until the latter is completely retracted, prevents the deformation of the cut fibers.

In the current state of technology, the industrial machines which perform the cutting of metal sheets by means of punching are so equipped as to have a punching assembly essentially constituted by the punch itself, the die underneath and a flexible element which moves the above mentioned punch.

The punch is held in a guide and can slide in the interior of a body known as a punch guide which also has the function of holding, at its lower end, the eventual blank-holder element should the use of this be required.

In its turn, the punch guide can slide within the seat machined on the bearing structure of the machine.

Structurally speaking the punching assembly therefore has two coaxial cylindrical profiles, in each of which is provided the coupling between the surface of the body which constitutes the hole and the surface of the body which constitutes the shaft. This coupling, being of the guide type, therefore requires that the two surfaces have to be machined to tolerance and with a very low degree of roughness.

Furthermore, in correspondence with each of the above mentioned profiles, a mechanical element, a key or other element, must be provided which is capable of preventing the relative displacement between the element which constitutes the hole and the element which constitutes the coupling shaft.

From the above it will therefore be apparent that the production of a punch assembly requires the machining, to tolerance and with a minimum degree of roughness, of at least four surfaces, i.e. those constituting the two couplings and the creation of at least two seats for the housing of the associated stop keys; all this involving increased costs requiring considerable accuracy between the die and punch.

SUMMARY OF THE INVENTION

The object of the invention is to provide a punch which has a profile shaped in such a way as to reduce, as far as cutting in half, the mechanical operations to be carried out to produce the component pieces, with respect to those which are necessary in order to produce the similar punches which are already known today and a punch which is also interchangeable with the known punches at the same time.

This object is achieved by providing that the body of the punch has, in addition to an upper shank which engages with the flexible means and a lower end which functions as a cutting blade, also radial projections, parallel to the axis of the body and developed in height as much as the above mentioned body and having their external surface coupled to the surface of the housing hole or seat machined on the structure of the machine.

With this novel solution the centering and the guiding of the central punch are achieved without requiring recourse to the use of the intermediate punch-guide body, which is indispensable in the current operations.

When the use of the blank-holder is required, the further novel feature of the invention resides in the fact that the same blank-holder is integral with a shaped element, placed above it, this element partially engaging in recesses produced on the body of the punch. These recesses have the dual function of centering and guiding the shaped element and, therefore, the blank-holder located underneath it.

The advantages of the punch according to the invention are evident from the above because the punch requires a single coupling to tolerance and has the surfaces in contact having minimum roughness, precisely in correspondence with the external surface of the projections of the punch and with the surface of the housing seat, as well as a single mechanical stop point (key) to prevent the rotation of the same punch.

Advantageously, therefore, the machining of the other surfaces of the body of the punch, excluding the surface in contact with the fixed seat, as well as the production of the entire shaped body and of the blank-holder anchored to it, can be carried out with mechanical processes which are not precision processes, with a considerable time saving and hence a considerable reduction in costs.

A preferred configuration of the shaped element comprises a flange, equipped at the bottom with a multiplicity of rods placed in circumferential fashion and having their end integral with a disc, which functions as blank-holder and as connection element between the same rods.

The blank-holder can be an element which is connected in movable manner to the rods or, in punches of smaller dimensions, may be an integral part of the body of the rods.

These and other features of the invention will be more clearly described by means of the description of some of its possible embodiments, given solely by way of non-limiting examples, and with the aid of the accompanying drawings, in which.

Figure 1:
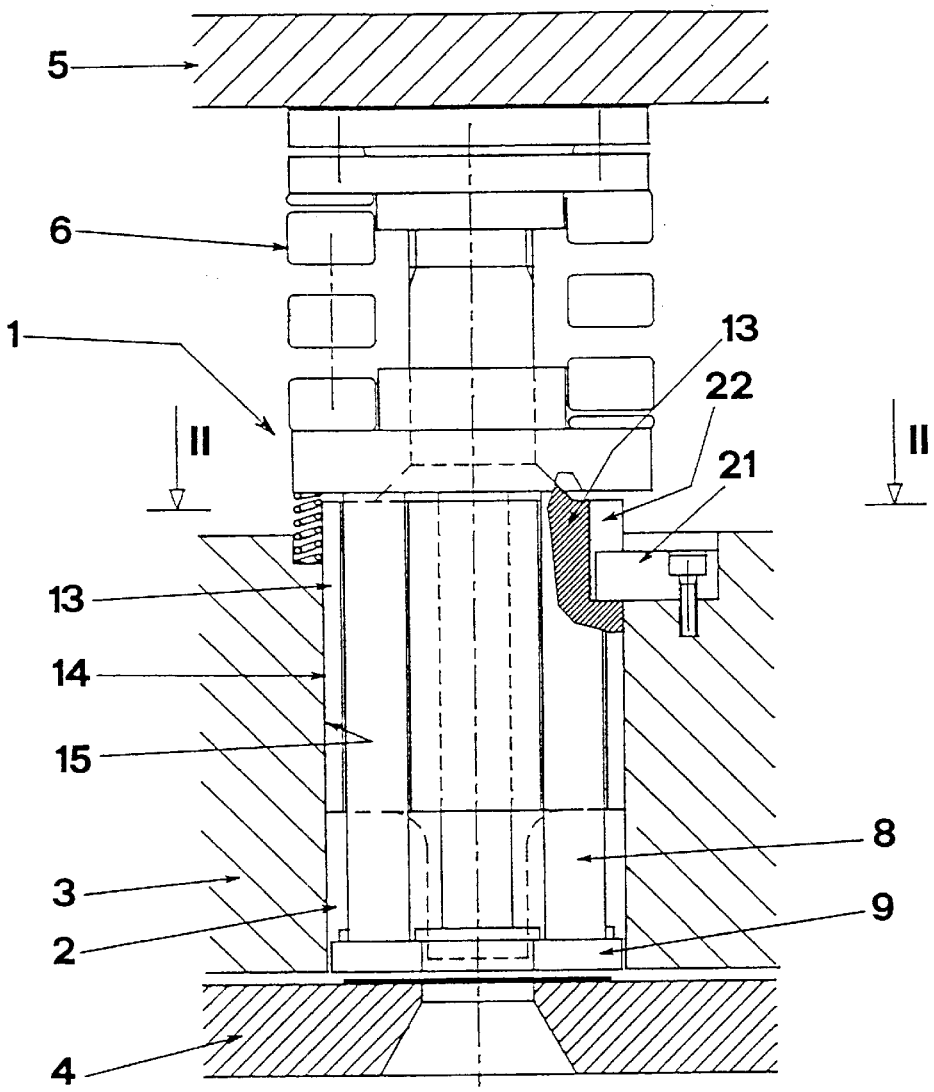
FIG. 1 is a front view, partially in cross section, of the punch assembly of this invention in the working position.
Figure 2:
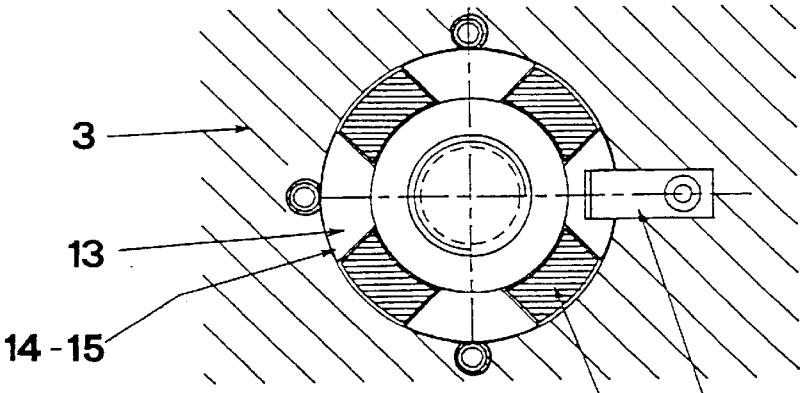
FIG. 2 is a plan view, in cross section according to line II—II of FIG. 1 of the punch assembly, in the working position.
Figures 3, 4, 5, 6, 7, 8, 9, 10:
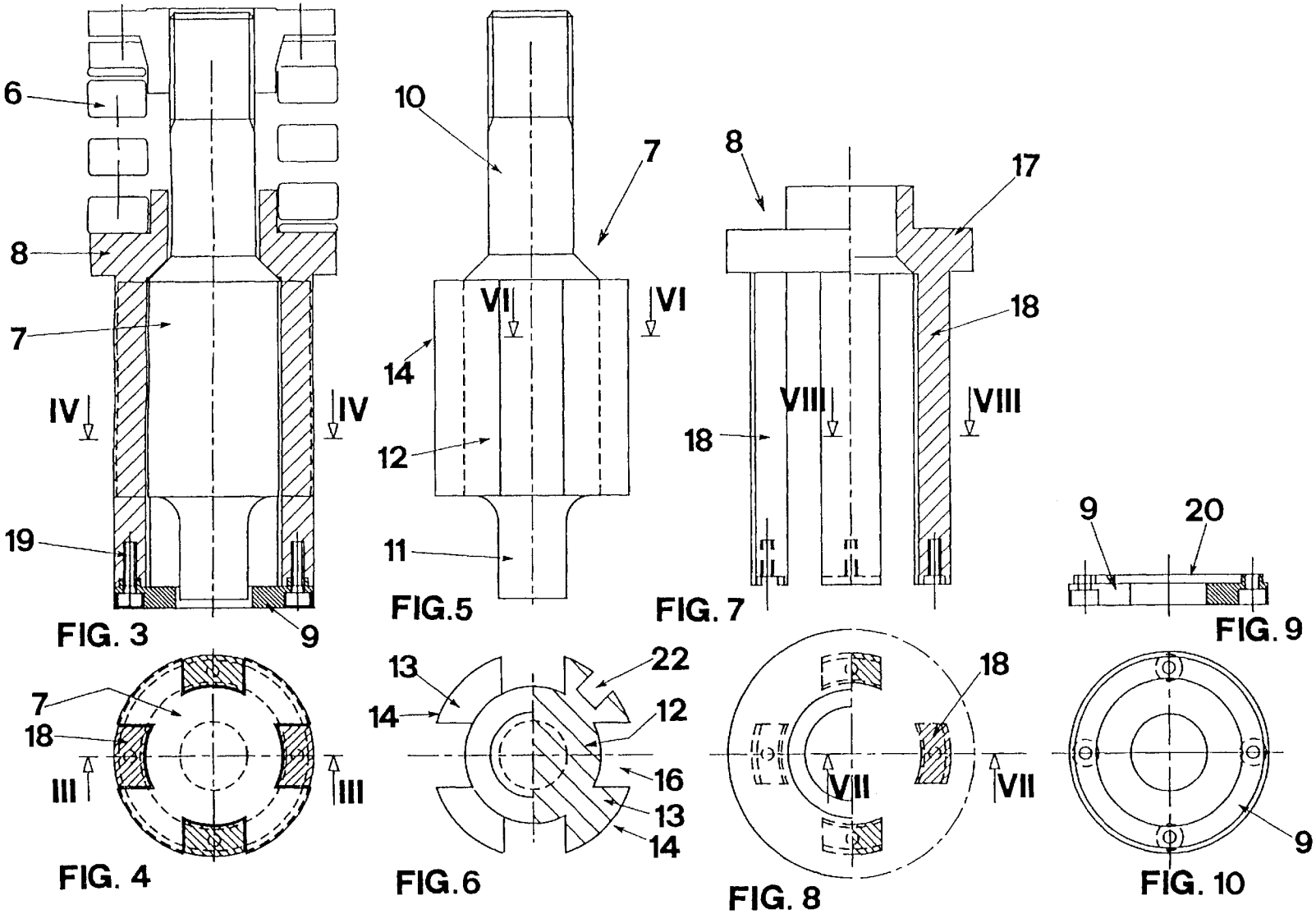
FIG. 3 is a front view, in cross section according to line III—III of FIG. 4, of the punch assembly.
FIG. 4 is a plan view, in cross section according to line IV—IV of FIG. 3, of the punch assembly.
FIG. 5 is a front view of the punch.
FIG. 6 is a plan view, partially in cross section according to line VI—VI of FIG. 5 of the punch.
FIG. 7 is a front view, partially in cross section according to line VII—VII of FIG. 8, of the shaped element.
FIG. 8 is a plan view, partially in cross section according to line VIII—VIII of FIG. 7, of the shaped element.
FIG. 9 is a front view, partially in cross section, of the blank-holder.
FIG. 10 is a plan view of the blank-holder.

As shown in FIGS. 1–10, the punch assembly 1 is placed inside the seat 2 machined on the fixed structure 3 of the machine tool, which has the die 4 at the bottom, the movable upright 5 and the elastic element 6 at the top.

The punch assembly 1 comprises the punch 7, placed in a central position in the seat 2, the shaped element 8, coaxial with the punch 7, and the blank-holder 9, integral with the terminal section of the element 8.

The punch 7 is characterized by the fact that it has, in addition to the upper shank 10, which engages with the elastic element 6 and with the shaped end 11, which functions as the cutting blade, also a central part 12,the latter being equipped with a multiplicity of radial projections 13, parallel to the axis of the same punch.

The external lateral surface 14 of the projections 13 coming into contact with and being coupled to tolerance to the surface 15 of the seat 2, machined in the body 3, ensures the guiding and centering of the punch 7.

The projections 13 bound slots 16 which are parallel to the axis of the punch 7, and enter the central part of the body 12 of the punch.

The shaped element 8 comprises a flange 17, the bottom of which is equipped with a multiplicity of rods 18 which engage in the slots 16 machined on the punch 7, after the above mentioned element 8 is placed in a coaxial manner with respect to the punch 7.

The profile of the cross-section of the rods 18 is similar to but of dimensions slightly smaller than the profile of the corresponding slots 16 within which the rods 18 engage, thus ensuring the positioning of the entire shaped element 8.

The blank-holder 9 is anchored to the end of the rods 18 by means of a movable connection with the screws 19 and the projection 20.

To prevent the rotation of the punch 7 about its own axis, a key 21 is provided which is integral with the body 3 and which engages with the punch 7 by means of the slot 22.

The principal advantage which characterizes the form of the entire punch assembly 1 described above lies in the fact that the only surfaces which require precision mechanical machining, i.e. to tolerance and with a minimum degree of roughness, are the external surface 14 of the projections 13 and the two walls of the slot 22 in contact with the key 21.

It therefore follows that all the other surfaces which constitute the three elements of the punch assembly 1 can be produced with mechanical operations which are not precision machinings and therefore with a considerable saving of both time and money.

Figure 11:
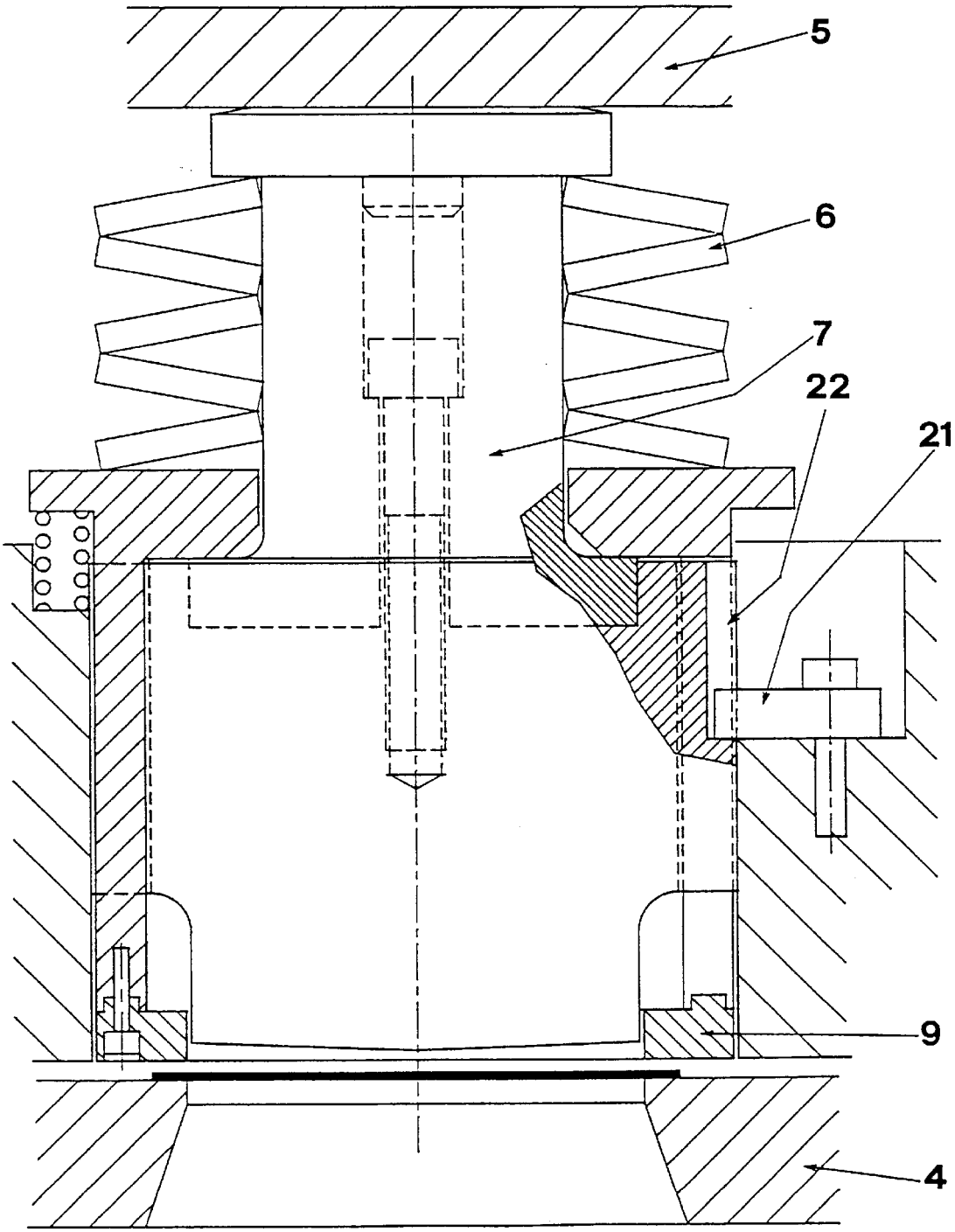
FIG. 11 is a front view in cross section of the punch assembly, with a punch of considerable dimensions.

The form of the radial projections 13 as well as the number and the cross-section of the rods 18 are variable as a function of the type of punch 7, as can be seen in FIG. 11, which shows a structural form of the punch assembly with a punch 7 of large dimensions.

Figure 12:
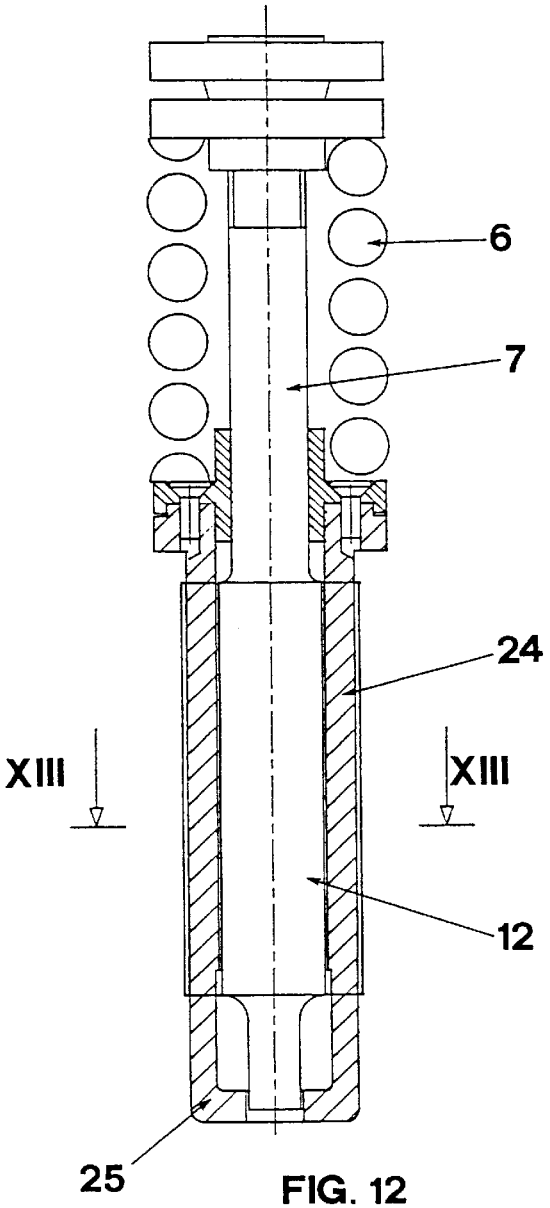
FIG. 12 is a front view in cross section according to line XII—XII of FIG. 13, of a punch assembly, with a punch of small dimensions.
Figure 14:
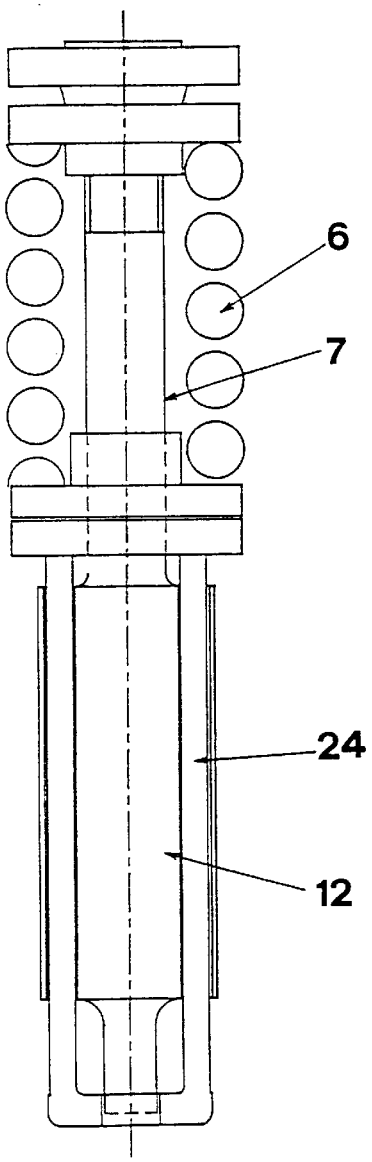
FIG. 14 is a front view of the punch assembly of FIG. 12.
Figure 13:
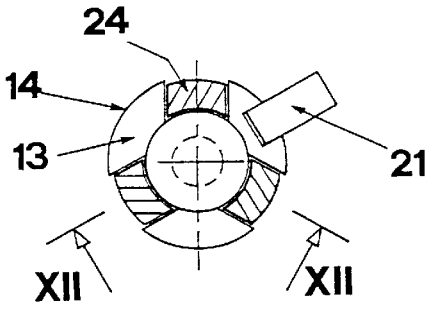
FIG. 13 is a plan view in cross section according to line XIII—XIII of FIG. 12, of the punch assembly.

When a punch 7 has a reduced cross-section, as shown in FIGS. 12, 13 and 14, the shaped element 24 has the end 25 configured in such a way as to function as a blank-holder.

What is claimed is:

1. A punch assembly to be mounted in a seat (2) formed in a fixed structure (3) of a punching machine, the punching machine having a die (4) at the bottom and a movable upright (5) at the top, said seat (2) having surface (15), the punch assembly comprising:

a punch (7) having a central longitudinal axis and having an upper shank (10), an intermediate part (12), and a shaped end (11) along the central longitudinal axis, said upper shank (10) engaging with said movable upright of the punching machine, the intermediate part (12) being formed with a plurality of projections (13) each of which laterally outwardly projects from said intermediate part and is formed with an external lateral surface (14), said punch having a plurality of first slots (16), each of which is formed between adjacent projections (13) along the periphery of said intermediate part and is formed with a laterally outwardly facing surface, the punch assembly also comprising a shaped element (8) coaxial with said punch (7) and a blank-holder (9), said shaped element (8) having a flange (17), a plurality of rods (18), said flange (17) having a bottom, said rods (18) being fixed on said flange (17), each of said rods (18) having a lower portion and an inner surface, said blank-holder (9) being anchored to said lower portions of said rods, wherein each of said rods (18) engages a slot (16), said slot (16) having a laterally outwardly facing surface whereby an inner surface of each rod (18) is in contact with said laterally outwardly facing surface of the slot (16) for guiding said intermediate part (12) of the punch (7) along the central longitudinal axis and the external lateral surface of the projections (14) is coupled to said surface (15) of said seat (2), and wherein said punching machine is provided with at least one key (21), said key being integral with said structure (3), said punch (7) has a second slot (22), said key (21) engages with said second slot (22) whereby rotation of the punch is prevented.

2. The punch assembly according to claim 1, wherein said rods (18) have a cross section of a dimension slightly smaller than said slots (16), whereby positioning of said shaped element (8) is ensured.

3. The punch assembly according to claim 1, wherein said second slot 22 has two walls and said punch assembly (1)

provides for the machining to tolerance and with a minimum degree of roughness of said external surfaces (14) of said projections (13) and of said two walls of said second slot (22).

4. A punch assembly to be mounted in a seat (2) formed in fixed structure (3) of a punching machine, the punching machine having a die (4) at the bottom, and a movable upright (5) at the top, said seat (2) having surface (15) the punch assembly comprising:

a punch (7) having a central longitudinal axis and having an upper shank (10), an intermediate part (12), and a shaped end (11) along the central longitudinal axis, said upper shank (10) engaging with said movable upright of the punching machine, the intermediate part (12) being formed with a plurality of projections (13) each of which laterally outwardly projects from said intermediate part and is formed with an external lateral surface (14), said punch having a plurality of first slots (16), each of which is formed between adjacent projections (13) along the periphery of said intermediate part and is formed with a laterally outwardly facing surface, thepunch assembly also comprising a shaped element (8) coaxial with said punch (7) and a blank-holder (9), said shaped element (8) having a flange (17), a plurality of rods (18), said flange (17) having a bottom, said rods (18) being fixed on said flange (17), each of said rods (18) having a lower portion and an inner surface, said blank-holder (9) being anchored to said lower portions of said rods, wherein each of said rods (18) engages a slot (16), said slot (16) having a laterally outwardly facing surface whereby an inner surface of each rod (18) is in contact with said laterally outwardly facing surface of the slot (16) for guiding said intermediate part (12) of the punch (7) along the central longitudinal axis and the external lateral surface of the projections (14) is coupled to said surface (15) of said seat (2), and wherein said punching machine is provided with first engaging means (21), the first engaging means being integral with said structure (3), said punch (7) has second engaging means (22), the first engaging means (21) engages with said second engaging means (22) whereby rotation of the punch is prevented.

* * * * *